US012185766B2

(12) United States Patent
Lee

(10) Patent No.: US 12,185,766 B2
(45) Date of Patent: Jan. 7, 2025

(54) AEROSOL GENERATING DEVICE

(71) Applicant: KT&G CORPORATION, Daejeon (KR)

(72) Inventor: Jaemin Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 356 days.

(21) Appl. No.: 17/627,934

(22) PCT Filed: Sep. 6, 2021

(86) PCT No.: PCT/KR2021/012054
§ 371 (c)(1),
(2) Date: Jan. 18, 2022

(87) PCT Pub. No.: WO2022/050798
PCT Pub. Date: Mar. 10, 2022

(65) Prior Publication Data

US 2022/0378109 A1 Dec. 1, 2022

(30) Foreign Application Priority Data

Sep. 7, 2020 (KR) ..... 10-2020-0113744
Jul. 16, 2021 (KR) ..... 10-2021-0093688

(51) Int. Cl.
*A24F 40/57* (2020.01)
*A24F 40/10* (2020.01)
*A24F 40/40* (2020.01)

(52) U.S. Cl.
CPC ..... *A24F 40/57* (2020.01); *A24F 40/10* (2020.01); *A24F 40/40* (2020.01)

(58) Field of Classification Search
CPC ..... A24F 40/57; A24F 40/10; A24F 40/40
USPC ..... 131/329
See application file for complete search history.

(56) References Cited

U.S. PATENT DOCUMENTS

| | | | | |
|---|---|---|---|---|
| 11,541,193 | B2 | 1/2023 | Lee | |
| 2016/0227840 | A1 | 8/2016 | Xiang | |
| 2018/0310622 | A1 | 11/2018 | Mironov et al. | |
| 2019/0124987 | A1* | 5/2019 | Wu | H05B 6/108 |
| 2020/0154772 | A1 | 5/2020 | Lim et al. | |
| 2020/0329776 | A1 | 10/2020 | Lee | |

(Continued)

FOREIGN PATENT DOCUMENTS

| | | | |
|---|---|---|---|
| CN | 202119077 | U | 1/2012 |
| CN | 108835718 | A | 11/2018 |

(Continued)

OTHER PUBLICATIONS

International Search Report of PCT/KR2021/012054 dated Dec. 14, 2021 [PCT/ISA/210].

(Continued)

*Primary Examiner* — Peter G Leigh
(74) *Attorney, Agent, or Firm* — Sughrue Mion, PLLC

(57) ABSTRACT

An aerosol-generating device controls power supplied to a heating unit based on a first target temperature during a first preheating section and control the power based on a second target temperature higher than the first target temperature during a second preheating section, such that the heating unit is stably heated to a target preheating temperature without carbonizing the aerosol generating substrate.

10 Claims, 9 Drawing Sheets

(56) References Cited

U.S. PATENT DOCUMENTS

| | | | |
|---|---|---|---|
| 2020/0368462 | A1 | 11/2020 | Lee et al. |
| 2020/0390153 | A1 | 12/2020 | Li et al. |
| 2021/0000185 | A1 | 1/2021 | Jung et al. |
| 2021/0029786 | A1 | 1/2021 | Lee |
| 2021/0093009 | A1 | 4/2021 | Park et al. |
| 2021/0112870 | A1 | 4/2021 | Park et al. |
| 2021/0127757 | A1 | 5/2021 | Lee et al. |
| 2021/0177065 | A1 | 6/2021 | Lee |
| 2021/0186114 | A1 | 6/2021 | Lee |
| 2021/0204611 | A1 | 7/2021 | Lee |
| 2021/0219617 | A1 | 7/2021 | Lee et al. |
| 2021/0298365 | A1 | 9/2021 | Huang et al. |
| 2022/0087309 | A1 | 3/2022 | Han et al. |
| 2022/0211117 | A1 | 7/2022 | Lin et al. |
| 2022/0248769 | A1 | 8/2022 | Li et al. |

FOREIGN PATENT DOCUMENTS

| | | | | | |
|---|---|---|---|---|---|
| CN | 109602091 | A | | 4/2019 | |
| CN | 110200329 | A | | 9/2019 | |
| CN | 110367593 | A | | 10/2019 | |
| CN | 110520004 | A | | 11/2019 | |
| CN | 110547511 | A | | 12/2019 | |
| CN | 110662438 | A | * | 1/2020 | ..... A24B 15/16 |
| CN | 211323076 | U | | 8/2020 | |
| EP | 3 818 894 | A1 | | 5/2021 | |
| JP | 2006039027 | A | | 2/2006 | |
| JP | 2018537077 | A | | 12/2018 | |
| KR | 10-2018-0070439 | A | | 6/2018 | |
| KR | 10-2018-0124755 | A | | 11/2018 | |
| KR | 2018124755 | A | * | 11/2018 | ..... A24B 15/16 |
| KR | 10-2019-0051785 | A | | 5/2019 | |
| KR | 10-2020-0009378 | A | | 1/2020 | |
| KR | 10-2020-0071391 | A | | 6/2020 | |
| KR | 1020200084696 | A | | 7/2020 | |
| WO | WO-2014102091 | A1 | * | 7/2014 | ..... A24F 40/20 |
| WO | WO-2017064487 | A1 | * | 4/2017 | ..... A24F 40/20 |
| WO | WO-2018202403 | A1 | * | 11/2018 | ..... A24F 40/46 |
| WO | WO-2018217030 | A1 | * | 11/2018 | ..... A24B 15/16 |
| WO | 2019/122344 | A1 | | 6/2019 | |
| WO | 2019/141577 | A1 | | 7/2019 | |
| WO | 2020027448 | A1 | | 2/2020 | |
| WO | 2020/101198 | A1 | | 5/2020 | |
| WO | 2020/101203 | A1 | | 5/2020 | |
| WO | 2020/101204 | A1 | | 5/2020 | |
| WO | 2020/101205 | A1 | | 5/2020 | |
| WO | 2020/101206 | A1 | | 5/2020 | |
| WO | 2020/116811 | A1 | | 6/2020 | |
| WO | 2020/122409 | A1 | | 6/2020 | |
| WO | 2020/126908 | A1 | | 6/2020 | |
| WO | 2020/141718 | A1 | | 7/2020 | |
| WO | WO-2020141064 | A1 | * | 7/2020 | ..... A24F 15/00 |

OTHER PUBLICATIONS

Written Opinion of PCT/KR2021/012054 dated Dec. 14, 2021 [PCT/ISA/237].

Extended European Search Report dated May 27, 2022, issued in European Application No. 21836312.5.

Korean Office Action dated Sep. 2, 2023 in Korean Application No. 10-2021-0093688.

Chinese Office Action dated Sep. 13, 2023 in Chinese Application No. 202180005233.9.

Japanese Office Action dated Jul. 4, 2023 in Japanese Application No. 2022-513844.

Communication dated Mar. 25, 2023 issued by the State Intellectual Property Office of the P.R.China in application No. 202180005233.9.

Communication dated Mar. 7, 2023 issued by the Japanese Patent Office in application No. 2022-513844.

Communication dated Jun. 11, 2024 in European Application No. 21 836 312.5.

Korean Office Action dated Aug. 22, 2024 in Application No. 10-2021-0093688.

* cited by examiner

AEROSOL GENERATING DEVICE

CROSS REFERENCE TO RELATED APPLICATIONS

This application is a National Stage of International Application No. PCT/KR2021/012054, filed Sep. 6, 2021, claiming priority to Korean Patent Application No. 10-2020-0113744, filed Sep. 7, 2020 and Korean Patent Application No. 10-2021-0093688, filed Jul. 16, 2021.

TECHNICAL FIELD

The present disclosure relates to an aerosol-generating device, and more particularly, to an aerosol-generating device for increasing the atomization amount and improving the taste of the aerosol.

BACKGROUND ART

Recently, demand for alternative methods for overcoming the shortcomings of general cigarettes has increased. For example, there is growing demand for an aerosol generating device that generates aerosols by heating a cigarette or an aerosol-generating material in a liquid storage without combustion.

Such an aerosol-generating device may preheat an aerosol-generating substrate (e.g., cigarette) in a preheating section that precedes a smoking section. However, when a heating unit is heated at only one target temperature, the initial atomization amount that a user expects may not be provided, or the heating unit may be carbonized. The lack of initial atomization amount and the carbonization of the heating unit may affect the flavors that the user feels.

DISCLOSURE

Technical Problem

Technical problems to be solved by the present disclosure are to provide an aerosol-generating device capable of increasing flavors that a user feels by increasing the initial atomization amount and preventing the carbonization of a heating unit.

The technical problems of the present disclosure are not limited to the above-described description, and other technical problems may be derived from the embodiments to be described hereinafter.

Technical Solution

According to an aspect of the present disclosure, an aerosol-generating device includes a battery, a heating unit configured to heat an aerosol-generating substrate based on power supplied to the battery, and a controller configured to control power supplied to the heating unit, based on a temperature profile including a preheating section and a smoking section, wherein, in the preheating section, the controller is configured to control the power supplied to the heating unit, based on a first target temperature and a second target temperature different from the first target temperature.

Advantageous Effects

An aerosol-generating device of the present disclosure may stably increase a temperature of a heating unit by heating the heating unit in stages based on multiple target temperatures in a preheating section.

Also, the aerosol-generating device may prevent the carbonization of an aerosol-generating substrate in a smoking section by stably preheating the temperature of the heating unit based on the target temperatures.

Also, the aerosol-generating device may provide a user with a sufficient amount of vapor in the smoking section by stably preheating the temperature of the heating unit based on the target temperatures.

However, effects of the present disclosure are not limited to the above effects, and effects that are not mentioned could be clearly understood by one of ordinary skill in the art from the present specification and the attached drawings.

BEST MODE

Figure 1:
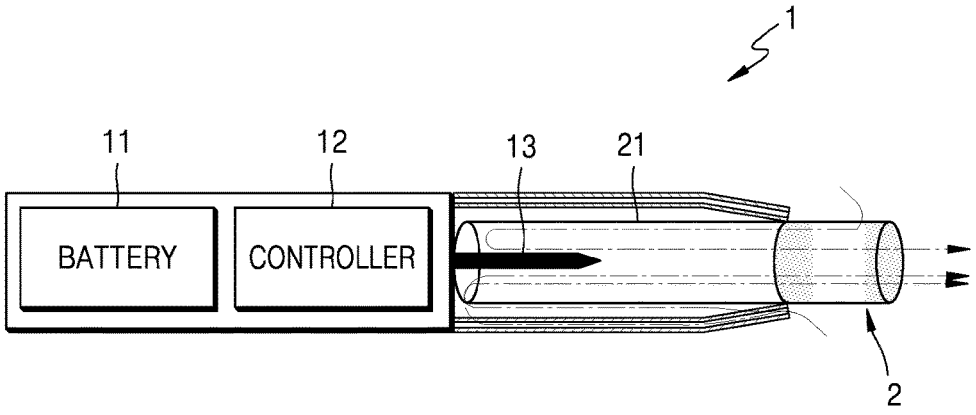
FIGS. 1 through 3 are diagrams showing examples in which a cigarette is inserted into an aerosol-generating device.

According to an aspect of the present disclosure, an aerosol-generating device includes a battery, a heating unit configured to heat an aerosol-generating substrate based on power supplied to the battery, and a controller configured to control power supplied to the heating unit, based on a temperature profile including a preheating section and a smoking section, wherein, in the preheating section, the controller is configured to control the power supplied to the heating unit, based on a first target temperature and a second target temperature different from the first target temperature.

The preheating section may include a first preheating section and a second preheating section following the first preheating section, and the controller may be configured to control the power supplied to the heating unit to make a temperature of the heating unit reach the first target temperature in the first preheating section, and control the power supplied to the heating unit to make the temperature of the heating unit reach the second target temperature in the second preheating section.

The first target temperature may be set to be lower than the second target temperature.

The first target temperature may be set between about 250° C. and about 335° C., and the second target temperature may be set between about 340° C. and about 360° C.

The first preheating section may be longer than the second preheating section.

The controller may be configured to set an upper limit of a current applied to the heating unit in a portion of the heating section.

The controller may be configured to control a current applied to the heating unit such that the temperature of the heating unit is maintained at a third target temperature in the smoking section.

The third target temperature may be set to be lower than the second target temperature.

The aerosol-generating device may further include a power converter configured to convert direct current power supplied from the battery into alternating current power, wherein the heating unit may include a coil configured to generate an alternating magnetic field, based on the alternating current power.

The heating unit may further include a susceptor configured to generate heat by the alternating magnetic field, and the controller may be configured to heat the susceptor by controlling the alternating power applied to the coil.

MODE FOR INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er," "-or," and "module" described in the specification mean units for processing at least one function and/or operation and can be implemented by hardware components or software components and combinations thereof.

As used herein, expressions such as "at least one of" when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

The term "cigarette" may refer to an article which can be loaded on an aerosol generating device to serve as a mouthpiece for a user. The cigarette may have a shape and a structure similar to those of a traditional combustive cigarette. This cigarette may contain an aerosol generating material that generates aerosols by operation (e.g., heating) of an aerosol generating device. Alternatively, the cigarette may not include an aerosol generating material and delivers an aerosol generated from another article (e.g., cartridge) installed in the aerosol generating device to the user's mouth.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 2:
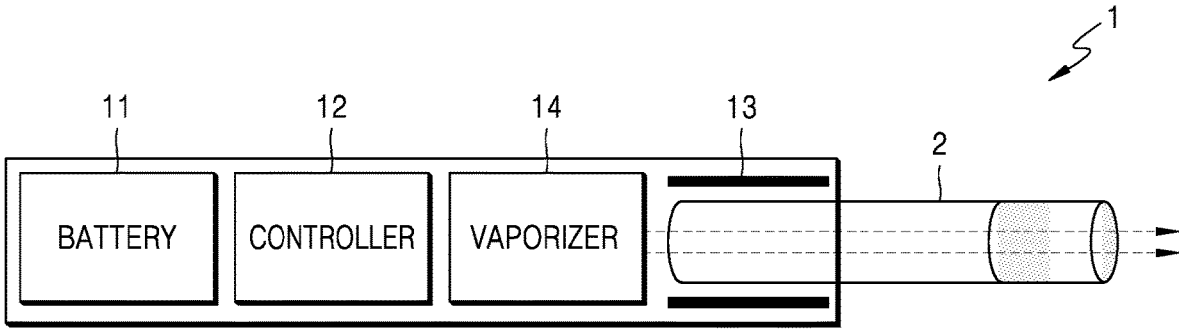
Figure 3:
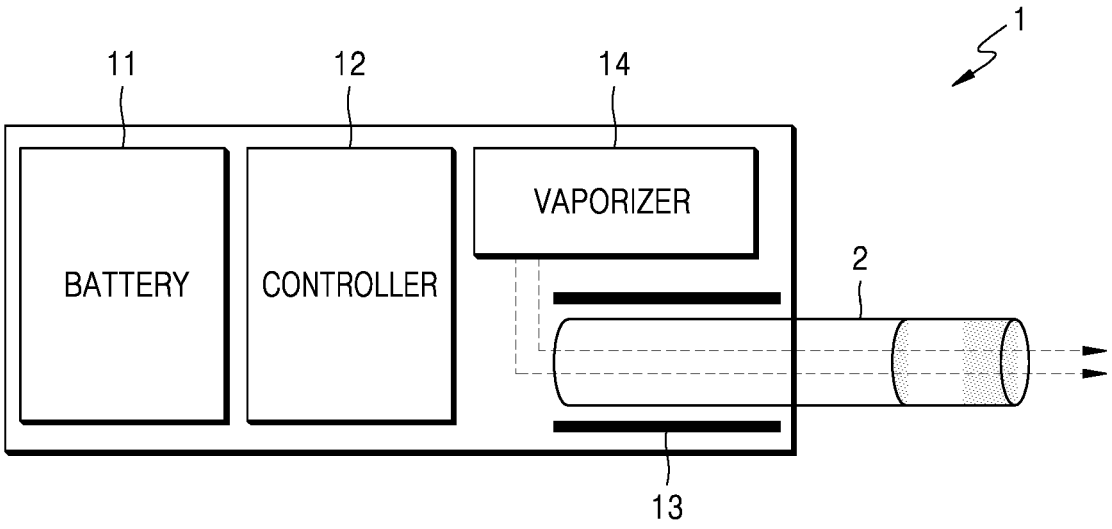

FIGS. 1 through 3 are diagrams showing examples in which a cigarette is inserted into an aerosol-generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, according to necessity, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 2 is inserted into the aerosol generating device 1, the aerosol generating device 1 may operate the heater 13 and/or the vaporizer 14 to generate an aerosol from the cigarette 2 and/or the vaporizer 14. The aerosol generated by the heater 13 and/or the vaporizer 14 is delivered to a user by passing through the cigarette 2.

According to necessity, even when the cigarette 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater. The induction heater will be described in more detail with reference to FIGS. 4 and 5.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate an aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached/detached to/from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (e.g., a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 2 may be similar as a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, the opening and closing and/or a size of the air passage formed in the aerosol generating device 1 may be adjusted by the user. Accordingly, the amount of smoke and a smoking impression may be adjusted by the user. As another example, the external air may flow into the cigarette 2 through at least one hole formed in a surface of the cigarette 2.

Figure 4:
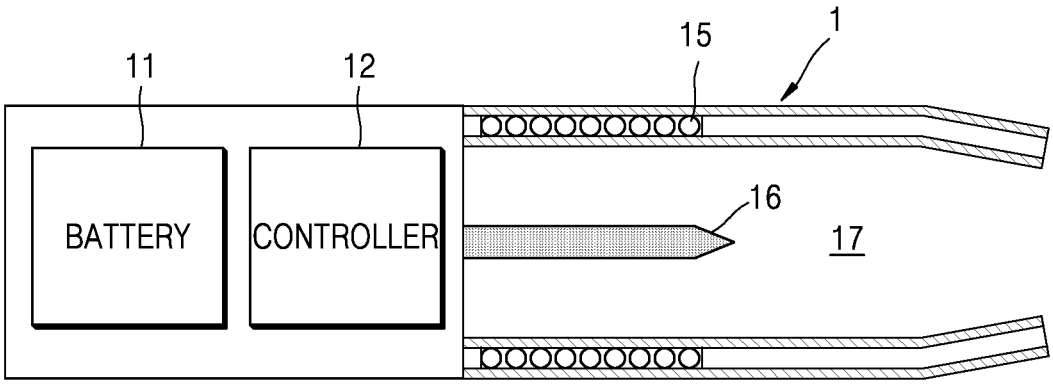
FIGS. 4 and 5 are diagrams illustrating an aerosol-generating device using an induction heating method.
Figure 5:
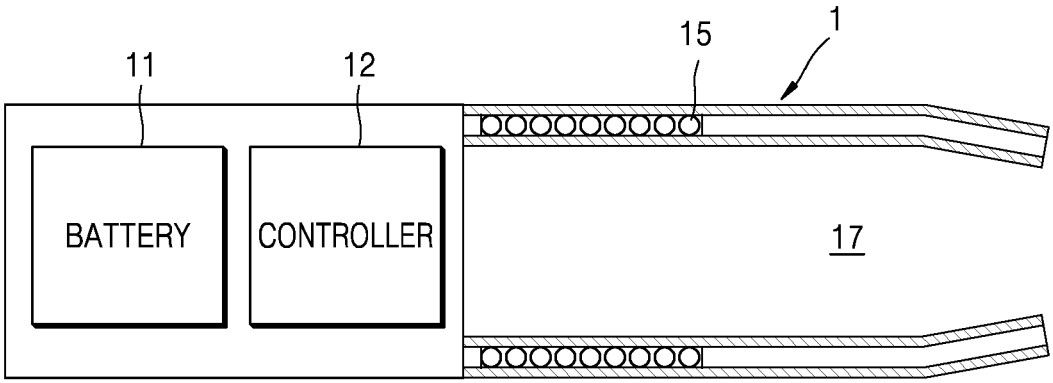

FIGS. 4 and 5 are diagrams illustrating an aerosol-generating device using an induction heating method.

Referring to FIG. 4, the aerosol-generating device 1 may include a susceptor 16, a coil 15, a battery 11, and a controller 12. According to an embodiment, the susceptor 16 may be included in a cigarette (200 of FIGS. 6 and 7). In this case, as illustrated in FIG. 5, the aerosol-generating device 1 may not include the susceptor 16.

The aerosol-generating device 1 of FIGS. 4 and 5 includes components associated with the present embodiment. Therefore, one of ordinary skill in the art may understand that additional general-purpose components other than the components of FIGS. 4 and 5 may be further included in the aerosol-generating device 1.

The aerosol-generating device 1 may generate an aerosol by heating the cigarette 2 accommodated in an accommodation space 17 according to the induction heating method. The induction heating method may indicate a method in which a conductive substance is heated by an alternating magnetic field that changes its direction periodically.

When an alternating magnetic field is applied to the magnetic substance, energy may be lost in the magnetic substance because of eddy currents and hysteresis loss, and the lost energy may be emitted from the magnetic substance as heat energy. As an amplitude or a frequency of an alternating magnetic field applied to the magnetic substance increases, the more heat energy may be emitted from the magnetic substance. The heat energy may be transferred to the cigarette 2.

The magnetic substance heated by the external magnetic field may be the susceptor 16. The susceptor 16 may be in the form of a piece, a flake, or a strip.

The susceptor 16 may include metal or carbon. The susceptor 16 may include at least one of ferrite, ferromagnetic alloy, stainless steel, and aluminum (Al). Also, the susceptor 16 may include at least one of ceramic such as graphite, molybdenum, silicon carbide, niobium, nickel alloy, a metal film, or zirconia, a transition element such as nickel (Ni) or cobalt (Co), and a metalloid such as boron (B) or phosphorus (P).

The aerosol-generating device 1 may include the accommodation space 17 in which the cigarette 2 is accommodated. The accommodation space 17 may include an opening for receiving the cigarette 2. The cigarette 2 may be inserted into the aerosol-generating device 1 through the opening of the accommodation space 17.

As illustrated in FIG. 4, the susceptor 16 may be arranged in the accommodation space 17. The susceptor 16 may be attached to a bottom of the accommodation space 17. The cigarette 2 may be pushed down to the bottom of the accommodation space 17 such that the susceptor 16 is inserted into the cigarette 2.

Alternatively, as illustrated in FIG. 5, the aerosol-generating device 1 may not include the susceptor 16. In this case, the susceptor 16 may be included in the cigarette 2.

The aerosol-generating device 1 may include the coil 15 which applies the alternating magnetic field to the susceptor 16 and varies the resonance frequency according to a temperature change of the susceptor 16 that is caused by induction heating of the susceptor 16.

The coil 15 may be a solenoid. The coil 15 may be a solenoid wound around the accommodation space 17, and the cigarette 2 may be accommodated in an internal space of the solenoid. A material of a conducting wire forming the solenoid may include copper (Cu). However, the material is not limited thereto. The material may be a material allowing a high current to flow because of a low non-resistance value, and examples of the material may include silver (Ag), gold (Au), aluminum (Al), tungsten (W), zinc (Zn), nickel (Ni), or an alloy including at least one of the materials listed above.

The coil 15 may be wound around the accommodation space 17 and may be at a location corresponding to the susceptor 16.

The battery 11 may supply power to the coil 15. The battery 140 may be a lithium iron phosphate ($LiFePO_4$) battery, but is not limited thereto. For example, the battery may be a lithium cobalt oxide ($LiCoO_2$) battery, a lithium titanate battery, or the like.

The controller 12 may control the power supplied to the coil 15. The controller 12 may change a driving frequency of the coil 15. The controller 12 may control induction heating of the susceptor 16 by controlling the driving frequency.

Figure 6:
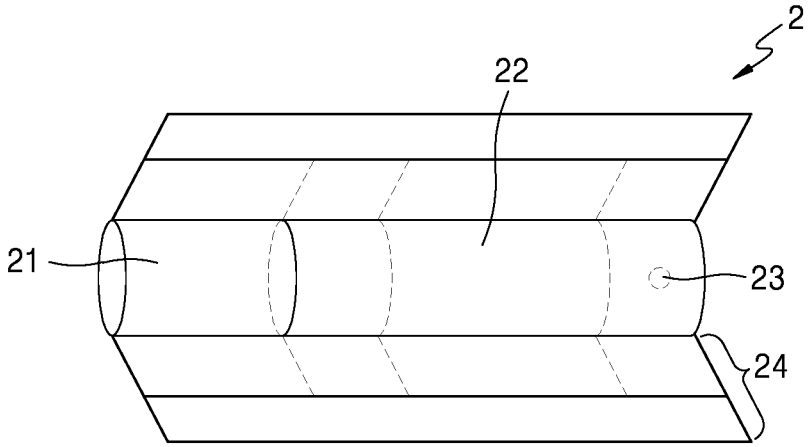
FIGS. 6 and 7 are diagrams of examples of a cigarette used in an aerosol-generating device using an induction heating method.
Figure 7:
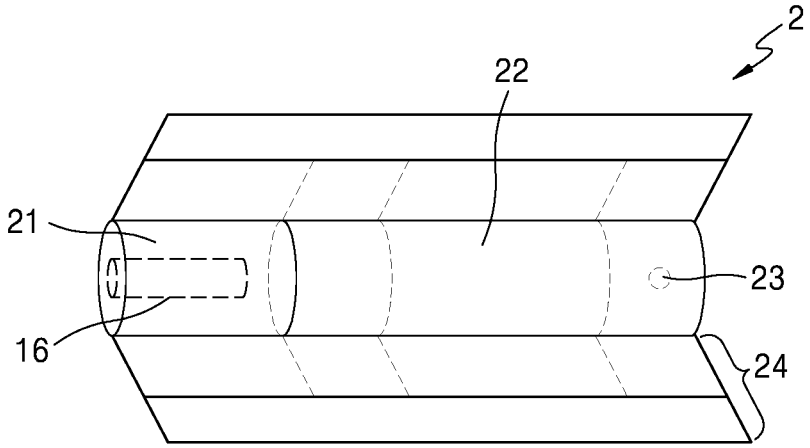

FIGS. 6 and 7 are diagrams of examples of a cigarette used in the aerosol-generating device using the induction heating method.

Referring to FIGS. 6 and 7, the cigarette 2 may include a tobacco rod 21 and a filter rod 22. The filter rod 22 may include one or more segments. For example, the filter rod 22 may include a first segment configured to cool an aerosol and a second segment configured to filter a certain component included in the aerosol. Also, the filter rod 22 may further include at least one segment configured to perform other functions.

The cigarette 2 may be packaged by at least one wrapper 24. The wrapper 24 may have at least one hole through which external air may be introduced or internal air may be discharged. For example, the cigarette 2 may be packaged by a single wrapper. As another example, as shown in FIGS. 6 and 7, the cigarette 2 may be double-packaged by at least two wrappers 24. For example, the tobacco rod 21 may be packaged by a first wrapper, and the filter rod 22 may be packaged by a second wrapper. Also, the tobacco rod 21 and the filter rod 22, which are respectively packaged by separate wrappers, may be coupled to each other, and the entire cigarette 2 may be packaged by a third wrapper.

The tobacco rod 21 may include an aerosol-generating material. For example, the aerosol-generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected into the tobacco rod 21.

The tobacco rod 21 may be manufactured in various forms. For example, the tobacco rod 21 may be formed as a sheet or a strand. Alternatively, the tobacco rod 210 may be formed as a pipe tobacco, which is formed of tiny bits cut from a tobacco sheet.

According to an embodiment, the cigarette 2 may further include the susceptor 16. In this case, as illustrated in FIG. 7, the susceptor 16 may be arranged on the tobacco rod 21. The susceptor 16 may extend in a direction towards the filter rod 22 from an end portion of the tobacco rod 21.

The tobacco rod 21 may be wrapped with a heat conductive material. For example, the heat conductive material may be, but is not limited to, a metal foil such as an aluminum foil. For example, the heat conductive material surrounding the tobacco rod 21 may uniformly distribute heat transmitted to the tobacco rod 21, and thus, the heat conductivity applied to the tobacco rod may be increased and a flavor of the aerosol generated from the tobacco rod 21 may be improved.

The filter rod 22 may include a cellulose acetate filter. Shapes of the filter rod 22 may vary. For example, the filter rod 22 may include a cylinder-type rod or a tube-type rod having a hollow. Also, the filter rod 22 may include a recess-type rod including a cavity. When the filter rod 22 includes a plurality of segments, the plurality of segments may have different shapes.

The filter rod 22 may be formed to generate flavors therefrom. For example, a flavoring liquid may be injected onto the filter rod 22, or an additional fiber coated with a flavoring liquid may be inserted into the filter rod 22.

Also, the filter rod 22 may include at least one capsule 23. The capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

When the filter rod 22 includes a segment configured to cool the aerosol, the cooling segment may include a polymer material or a biodegradable polymer material. For example, the cooling segment may include pure polylactic acid alone. In some embodiments, the cooling segment may include a cellulose acetate filter having a plurality of holes. However, the cooling segment is not limited thereto and may include a configuration, in which an aerosol is cooled, and an aerosol cooling material.

Figure 8:
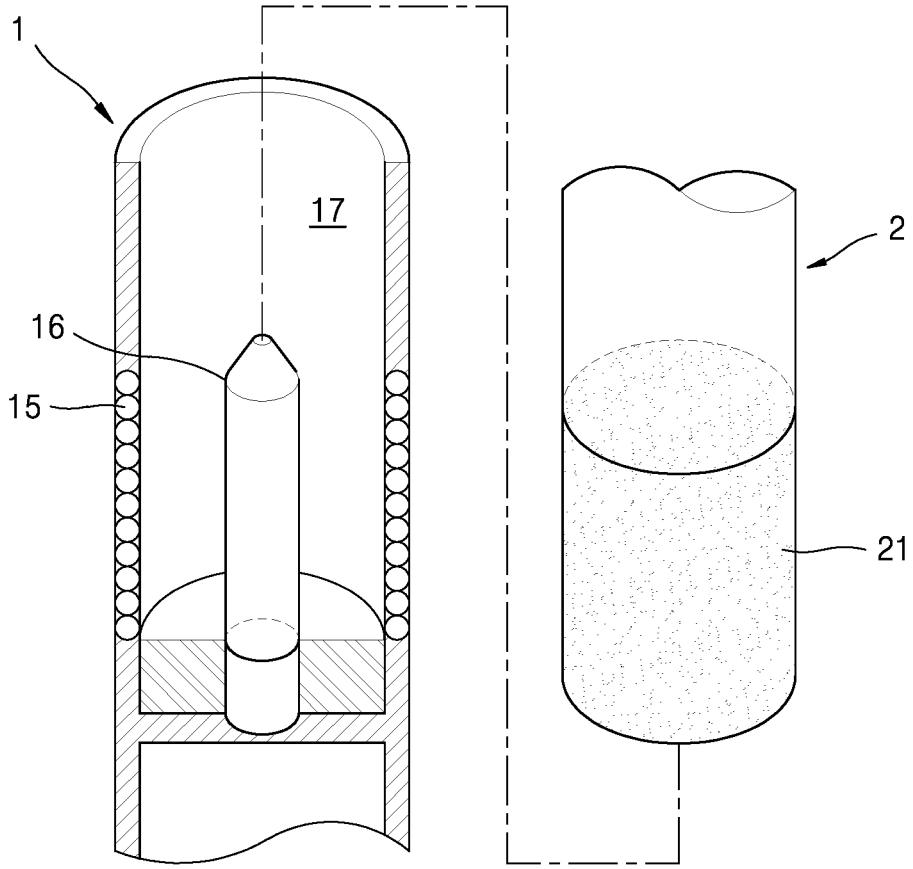
FIGS. 8 and 9 are diagrams of examples of a cigarette inserted into an aerosol-generating device using an induction heating method.
Figure 9:
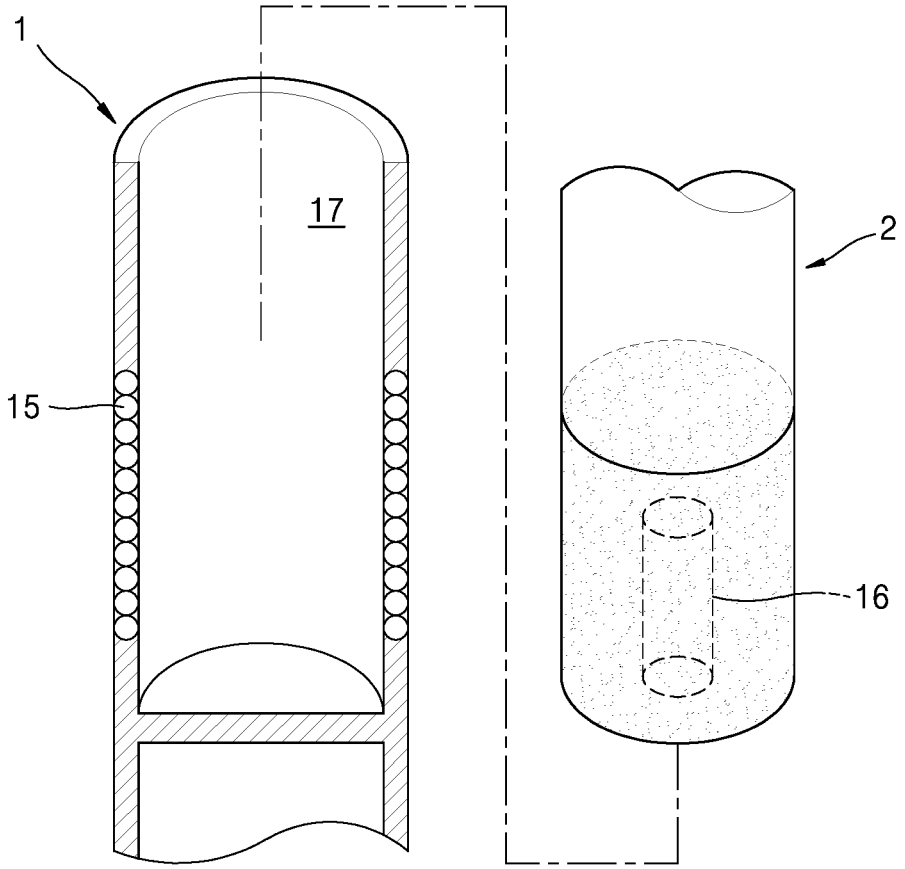

FIGS. 8 and 9 are diagrams of examples of a cigarette inserted into the aerosol-generating device using the induction heating method.

In more detail, FIG. 8 illustrates an example in which the susceptor 16 is arranged on the aerosol-generating device 1, and FIG. 9 illustrates an example in which the susceptor 16 is arranged on the cigarette 2.

Referring to FIG. 8, the cigarette 2 may be accommodated in the accommodation space 17 in a lengthwise direction of the cigarette 2. The susceptor 16 may be inserted into the cigarette 2 accommodated in the aerosol-generating device 1 such that the tobacco rod 21 may contact the susceptor 16. The susceptor 16 may extend in a lengthwise direction of the aerosol-generating device 1 such that the susceptor 16 may be inserted into the cigarette 2.

The susceptor 16 may be at the center of the accommodation space 17 to be inserted into a central portion of the cigarette 2. FIG. 8 illustrates a single susceptor 16, but the number of the susceptor 16 is not limited thereto. In other words, the aerosol-generating device 1 may include multiple susceptors that extend in the lengthwise direction of the aerosol-generating device 1 to be inserted into the cigarette 2.

The coil 15 may be wound around the accommodation space 17 along a lengthwise direction of the accommodation space 17. The coil 15 may extend, in the lengthwise direction of the accommodation space 17, to a length corresponding to the susceptor 16 and may be at a location corresponding to the susceptor 16.

Referring to FIG. 9, the cigarette 2 may be accommodated in the accommodation space 17 in the lengthwise direction of the cigarette 2. As the cigarette 2 is accommodated in the accommodation space 17, the susceptor 16 may be surrounded by the coil 15.

The susceptor 16 may be at the center of the tobacco rod 21 for uniform heat transmission. FIG. 9 illustrates a single susceptor 16, but the number of the susceptor 16 is not limited thereto. In other words, a plurality of susceptors may be included in the cigarette 2.

The coil 15 may be wound around the accommodation space 17 along the lengthwise direction of the accommodation space 17. The coil 15 may extend, in the lengthwise direction of the accommodation space 17, to the length corresponding to the susceptor 16 and may be at a location corresponding to the susceptor 16.

Figure 10:
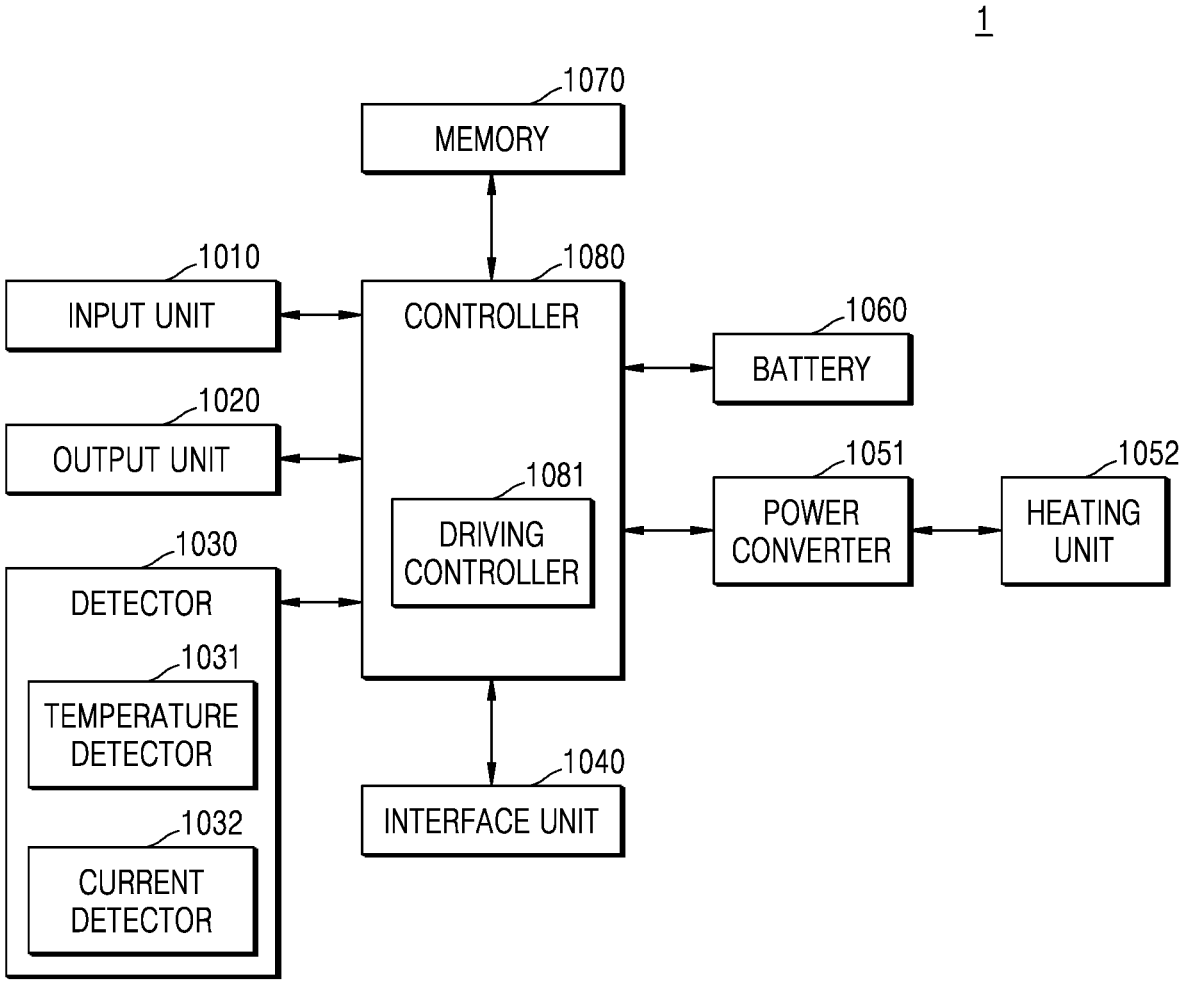
FIG. 10 is an internal block diagram of an aerosol-generating device according to an embodiment.

FIG. 10 is an internal block diagram of an aerosol-generating device according to an embodiment.

Referring to FIG. 10, the aerosol-generating device 1 may include an input unit 1010, an output unit 1020, a detector 1030, an interface unit 1040, a heating unit 1052, a battery 1060, a memory 1070, and a controller 1080. When the aerosol-generating device 1 operates according to the induction heating method, the aerosol-generating device 1 may further include a power converter 1051.

The battery 1060 and the controller 1080 of FIG. 10 may respectively correspond to the battery 11 and the controller 12 of FIGS. 1 to 5. The heating unit 1052 of FIG. 10 may correspond to the heater 13 of FIGS. 1 to 3. When the aerosol-generating device 1 operates according to the induction heating method, the heating unit 1052 of FIG. 10 may correspond to the coil 15 of FIGS. 4 and 5. According to an embodiment, the heating unit 1052 of FIG. 10 may include the susceptor 16 of FIGS. 4 and 5.

The input unit 1010 may receive a user input. For example, the input unit 1010 may be a press-type push button, but is not limited thereto. When the input unit 1010 receives a user input, a control signal corresponding to the user input may be transmitted to the controller 1080. The controller 1080 may control internal components of the aerosol-generating device 1 in response to the control signal. For example, the controller 1080 may supply power to the heating unit 1052 in response to the control signal.

The output unit 1020 may output visual information and/or tactile information associated with the aerosol-generating device 1. To this end, the output unit 1020 may include a display (not illustrated), a vibration motor (not illustrated), and the like.

The detector 1030 may detect information related to the operation of the aerosol-generating device 1. The detector 1030 may include a temperature detector 1031 for detecting a temperature of the heating unit 1052 and a current detector 1032 for detecting a current applied to the heating unit 1052. According to an embodiment, the detector 1030 may further include a puff sensor for detecting a user's puff.

The temperature detector 1031 may include at least one temperature sensor, and the temperature sensor may be arranged adjacent to the heating unit 1052. The current detector 1032 may include at least one shunt resistor. When the aerosol-generating device 1 operates according to the induction heating method, the current detector 1032 may be connected in series to the coil 15 and detect a current applied to the coil 15.

The interface unit 1040 may function as a passage to external devices of various types that are connected to the aerosol-generating device 1. For example, the interface unit 1040 may include a port that may be connected to an external device, and the aerosol-generating device 1 may be connected to the external device through the port. While connected to the external device, the aerosol-generating device 1 may exchange data with the external device. The interface unit 1040 may function as a passage through which external power is supplied. For example, the interface unit 1040 may include a port that may be connected to an external device, and the aerosol-generating device 1 may receive external power from an external power supply while the aerosol-generating device 1 is connected to the external power supply.

The heating unit 1052 may heat an aerosol-generating substrate. As the aerosol-generating substrate is heated, an aerosol may be generated. The aerosol-generating substrate may be the cigarette 2 of FIGS. 1 to 3, 7, and 8.

The heating unit 1052 may include the coil 15. Also, the heating unit 1052 may further include a capacitor (not illustrated) to be inductively coupled to the susceptor 16. According to an embodiment, the heating unit 1052 may further include the susceptor 16.

When the current is applied to the coil 15, the susceptor 16 may be heated by an alternating magnetic field generated in the coil 15. The heated susceptor 16 may heat the aerosol-generating substrate, and thus, the aerosol may be generated.

According to an embodiment, the heating unit 1052 may not include the susceptor 16, and the susceptor 16 may be included in the aerosol-generating substrate. In this case, the heating unit 1052 may be referred to as a magnetic field generator.

The battery 1060 may supply power to the heating unit 1052 under the control of the controller 1080.

In this case, the power converter 1051 may convert the power supplied from the battery 1060 and transmit the converted power to the heating unit 1052.

The power converter 1051 may convert DC power supplied from the battery 1060 to AC power and may transmit the AC power to the heating unit 1052. The power converter 1051 may include switching devices for converting the DC power to AC power.

The memory 1070 may store information used to operate the aerosol-generating device 1. In an embodiment, the memory 1070 may store information regarding temperature profiles.

The temperature profile may include information regarding a target temperature corresponding to a heating section. The heating section may include a preheating section, in which a temperature of the heating unit 1052 increases to a preset preheating temperature, and a smoking section, in which the temperature of the heating unit 1052 is maintained in a certain range.

The preheating section indicates a section in which the temperature of the heating unit 1052 increases to a temperature at which aerosols are sufficiently generated. The smoking section indicates a section in which the temperature of the heating unit 1052 is maintained such that the aerosols are sufficiently generated. In the smoking section, the user may inhale the aerosol-generating substrate by puffing. When the aerosol-generating device 1 operates according to the induction heating method, the temperature of the heating unit 1052 may be a temperature of the susceptor 16.

The controller 1080 may control power supplied to the heating unit 1052 by adjusting at least one of a frequency and a duty of a current pulse supplied to the heating unit 1052. The duty may indicate a percentage of a time period during which a switching device is turned on in one switching period. Therefore, in the present specification, the duty may be identical to a duty ratio.

When the aerosol-generating device 1 operates according to the induction heating method, the power supplied to the heating unit 1052 may be power supplied to the coil 15. When the power is supplied to the coil 15, the susceptor 16 may be heated in a non-contact manner by the alternating magnetic field generated by the coil 15. According to the induction heating method, heat loss may dramatically decrease because heat conduction is not involved. As a result, the aerosol-generating substrate may be rapidly heated.

The controller 1080 may control the power supplied to the heating unit 1052 by controlling the power converter 1051. In an embodiment, the controller 1080 may control the power converter 1051 by using a Pulse Width Modulation (PWM) method. The controller 1080 may control switching devices included in the power converter 1051 by using the PWM method. To this end, the controller 1080 may include a driving controller 1081 that controls the switching devices. According to an embodiment, the driving controller 1081 may be formed as an individual component distinct from the controller 1080.

The controller 1080 may control the power supplied to the heating unit 1052, based on the temperature profile. The temperature profile may include the preheating section and the smoking section. The temperature profile may include information regarding a target temperature that the heating unit 1052 needs to reach, and the controller 1080 may control the power supplied to the heating unit 1052 to heat the heating unit 1052 to the target temperature.

Because the user puffs in the smoking section, it is better to shorten the preheating section. However, if the heating unit 1052 is heated very rapidly, the temperature of the heating unit 1052 may increase above the appropriate temperature for generating the aerosols, which may result in carbonization of the aerosol-generating substrate. On the contrary, if the temperature of the heating unit 1052 gradually increases from the beginning of the preheating section, a preheating time will be prolonged, which results in the user dissatisfaction. In this regard, the aerosol-generating device 1 according to an embodiment may perform n-step temperature control in the preheating section. Hereinafter, a two-step temperature control method will be described as an example of the n-step temperature control, but according to an embodiment, three or more steps may be included in the n-step temperature control.

In the preheating section, the controller 1080 may control the power supplied to the heating unit 1052, based on a first target temperature and a second target temperature different from the first target temperature.

In detail, the preheating section may include a first preheating section and a second preheating section following the first preheating section. The first preheating section may be longer than the second preheating section. The controller 1080 may heat the heating unit 1052 based on the first target temperature in the first heating section and may control the power supplied to the heating unit 1052 based on the second target temperature in the second preheating section. If the target temperature is set to be high at a heating start point, the aerosol-generating substrate may be carbonized because of a drastic temperature increase of the heating unit 1052, and the battery 1060 may be overloaded. In this respect, the first target temperature may be set to be lower than the second target temperature such that the temperature of the heating unit 1052 may stably increase.

In the smoking section after the preheating section, the controller 1080 may control the power supplied to the heating unit 1052 based on a third target temperature. The third target temperature may be set to be lower than the second target temperature. Setting the third target temperature to be lower than the second target temperature is to compensate for an increase in a preheating time that is caused by setting an upper limit of a current described below. In an embodiment, the third target temperature may be identical to the first target temperature.

The controller 1080 may feedback-control the power supplied to the heating unit 1052 to make the temperature of the heating unit 1052 reach the target temperature in the preheating and smoking sections. In an embodiment, the controller 1080 may control the temperature of the heating unit 1052 according to a Proportional-Integral-Derivative (PID) control method. In other words, the controller 1080 may control the power supplied to the heating unit 1052 according to a feedback control method using a difference between the temperature of the heating unit 1052 and the target temperature, an integral value of the difference over time, and a differential value of the difference over time. A coefficient of the PID control may be experimentally set in advance so that the temperature of the heating unit 1052 may be optimally controlled. The controller 1080 may control the power supplied to the heating unit 1052 to make the temperature of the heating unit 1052 reach the target temperature, according to the coefficient of the PID control.

When the heating unit 1052 is heated according to the feedback control method from the start of heating, the battery 1060 may be overloaded because of ripple components of the current. Also, the ripple components of the current may function as ElectroMotive Force (EMF) noise, and thus, the serious damage to the battery 1060 may occur.

To solve the aforementioned problems, the aerosol-generating device 1 may limit the current for heating the heating unit 1052 in a portion of the first preheating section which includes the heating start point.

The controller 1080 may set the upper limit of the current applied to the heating unit 1052 in a portion of the first preheating section. The current may be only limited in a portion of the first preheating section to prevent a delay in the preheating due to the limited current.

Figure 11:
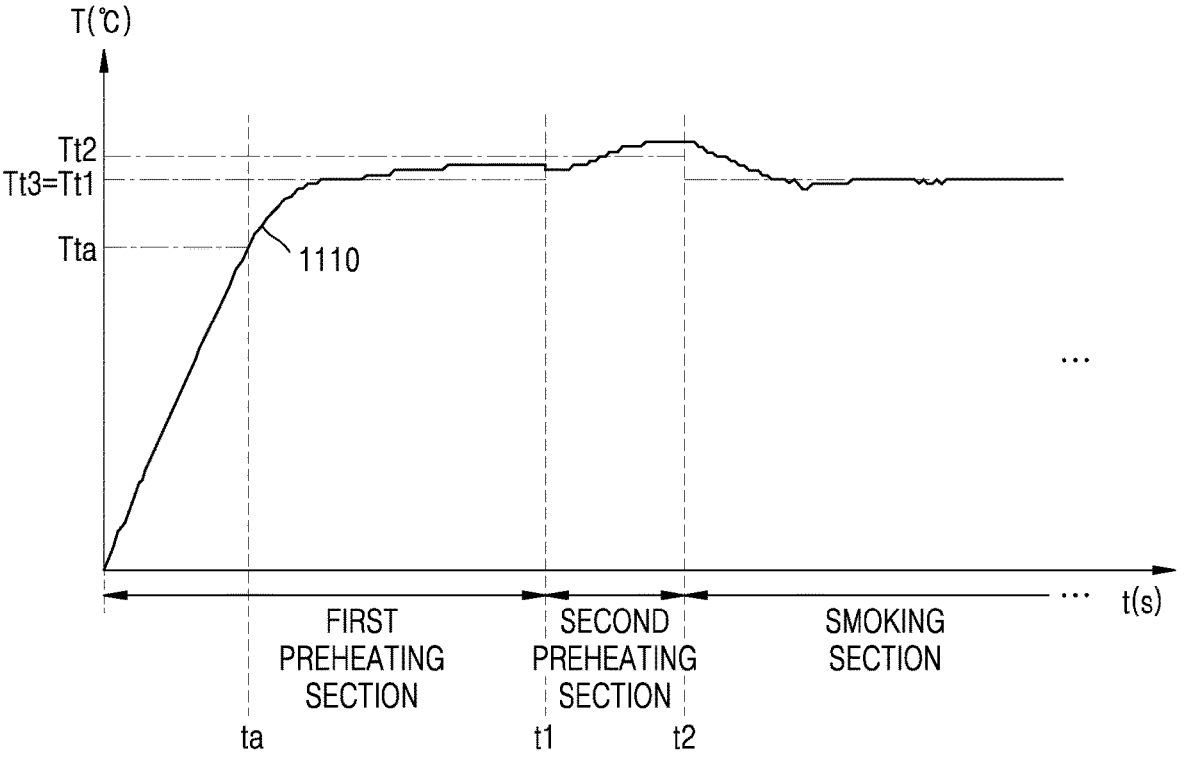
FIG. 11 is a diagram for explaining a power control method according to a temperature profile, according to an embodiment.

FIG. 11 is a diagram for explaining a power control method according to a temperature profile, according to an embodiment.

FIG. 11 illustrates a temperature 1110 of the heating unit 1052 over time. That is, the x-axis indicates time, and the y-axis indicates a temperature. When the aerosol-generating device 1 operates according to an induction heating method, the temperature 1110 of the heating unit 1052 may indicate the temperature 1110 of the susceptor 16. Hereinafter, a case where the aerosol-generating device 1 operates according to an induction heating method is only described, but the method below may be applied to a resistive heating method.

The controller 1080 may heat the susceptor 16 according to the temperature profile. The temperature profile may include information regarding a target temperature and a heating time. The temperature profile may be divided into the preheating section and the smoking section, based on the target temperature and/or the heating time. The preheating section may indicate a section in which the temperature 1110 of the susceptor 16 increases to the target temperature. The smoking section is a section in which puffs actually occur and the temperature 1110 of the susceptor 16 is maintained in a target temperature range set in advance.

If the controller 1080 heats the heating unit 1052 based on one target temperature within a short time in the preheating section, the temperature of the heating unit 1052 may sharply increase, and such a sharp temperature increase of the heating unit 1052 may cause the carbonization of the aerosol-generating substrate. On the other hand, if the controller 1080 heats the heating unit 1052 based on one target temperature for a long time in the preheating section, the preheating time may severely increase, resulting in the user dissatisfaction. To solve the problems above, the aerosol-generating device 1 according to an embodiment may perform the two-step temperature control in the preheating section.

The preheating section may be divided into the first preheating section and the second preheating section following the first preheating section.

From the start of the preheating, the controller 1080 may control the power supplied to the coil 15 based on a first target temperature Tt1 until the time point t1, according to the temperature profile. The time point t1 may correspond to the end point of the first preheating section.

The controller 1080 may control the power converter 1051 to make the temperature 1110 of the susceptor 16 reach the first target temperature Tt1, in the first preheating section. In the first preheating section, the temperature 1110 of the susceptor 16 may increase to or above the first target temperature Tt1. In an embodiment, the first target temperature Tt1 may be set between about 250° C. and about 335° C.

During a second preheating section (i.e., during a period between the time point t1 and the time point t2), the controller 1080 may control the power supplied to the coil 15 based on a second target temperature Tt2. The time point t2 may correspond to the start point of the smoking section.

The second preheating section may be shorter than the first preheating section. For example, when the second preheating section is three seconds, the first preheating section may be 15 seconds. This is to prevent a dramatic temperature increase of the susceptor 16.

The controller 1080 may control the power converter 1051 to make the temperature 1110 of the susceptor 16 reach the second target temperature Tt2, in the second preheating section. In the second preheating section, the temperature 1110 of the susceptor 16 may increase to or above the second target temperature Tt2. The second target temperature Tt2 may be higher than the first target temperature Tt1. This is to prevent the carbonization of the aerosol-generating substrate caused by the overload of the battery 1060 and to prevent the dramatic temperature increase of the susceptor 16 caused by the abrupt supply of power at the heating start point. In an embodiment, the second target temperature Tt2 may be set between about 340° C. and about 360° C. Setting an upper limit of the second target temperature Tt2 to be about 360° C. is to prevent the carbonization of the aerosol-generating substrate.

As the aerosol-generating device 1 performs the two-step temperature control in the preheating section, the susceptor 16 may be stably preheated to a target temperature without the carbonization of the aerosol-generating substrate. Accordingly, the aerosol-generating device 1 may provide the sufficient amount of vapor with a quality flavor to the user in the smoking section.

The controller 1080 may not use the feedback control method to heat the susceptor 16 in the early stage of the first preheating section. This is to reduce ripples of the current which may be generated during the feedback control.

In detail, the controller 1080 may set the upper limit of the current applied to the coil 15 until the preset reference time point ta from the heating start point.

The reference time point ta may be set based on the time taken by the susceptor 16 to reach a reference temperature Tta. The reference temperature Tta may set differently based on whether the coil 15 is able to perform the overshoot control and the reference temperature Tta may be set to be lower than the first target temperature Tt1. For example, the reference temperature Tta may be set in a range of about (Tt1-200°) C. to about (Tt1-30°) C. In an embodiment, the reference temperature Tta may be set to be about (Tt1-35) ° C. As long as the reference temperature Tta is set to be lower than the first target temperature Tt1, the reference time point ta may precede an end point of the first preheating section. In other words, the controller 1080 may set the upper limit of the current applied to the coil 15 only in a portion of the first preheating section, starting from the start point of the first preheating section.

The upper limit of the current may be set to a value between about 1 A and about 4 A. A lower end of the range is set to be 1 A because a minimum current supply to the coil 15, which is required to heat the susceptor 16, is about 1 A. Also, the upper end of the range is set to be 4 A because a rated current of the battery 1060 is 6 A, and a sum of required currents of other components than the coil 15 is equal to 2 A.

The controller 1080 may control the power supplied to the coil 15 based on the third target temperature Tt3 during a preset smoking time after the time point t2. The smoking time may correspond to the smoking section. For example, the smoking time may be set to be 240 seconds.

The controller 1080 may control the power converter 1051 to make the temperature 1110 of the susceptor 16 reach the third target temperature Tt3 in the smoking section. In the smoking section, the temperature 1110 of the susceptor 16 may be maintained in a preset range based on the third target temperature Tt3. The third target temperature Tt3 may be lower than the second target temperature Tt2. This is to compensate for an increase in the preheating time which is caused by setting the upper limit of the current applied to the coil 15 in the early stage of the first preheating section. In an embodiment, the third target temperature Tt3 may be identical to the first target temperature Tt1.

Figure 12:
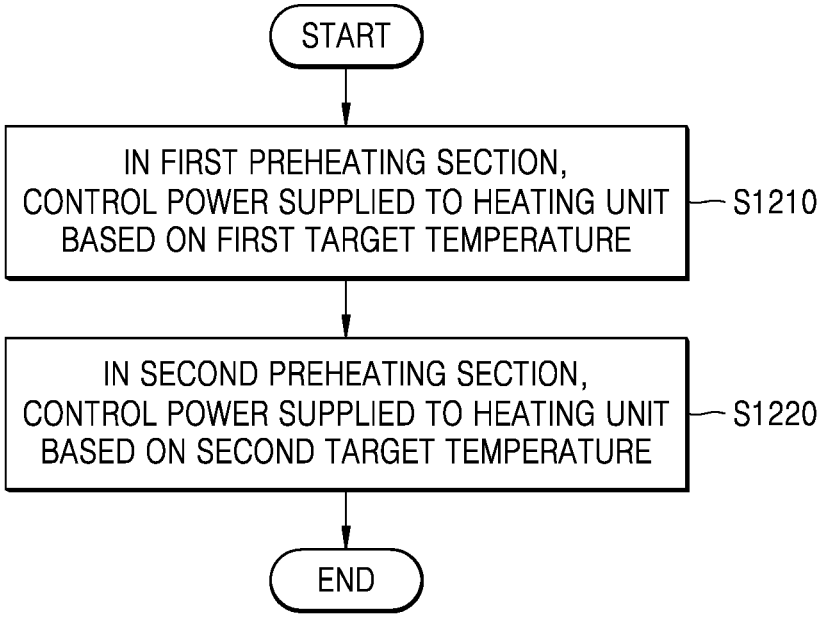
FIG. 12 is a flowchart of an operation method of an aerosol-generating device, according to an embodiment.

FIG. 12 is a flowchart of an operation method of an aerosol-generating device, according to an embodiment.

Referring to FIG. 12, in operation S1210, the controller 1080 may control the power supplied to the heating unit 1052 based on the first target temperature in the first preheating section.

In the first preheating section, the controller 1080 may control the power converter 1051 to make the temperature of the susceptor 16 reach the first target temperature. In the first preheating section, the temperature of the susceptor 16 may increase to or above the first target temperature.

In the early stage of the first preheating section, the controller 1080 may not use the feedback control method to heat the susceptor 16. In other words, the feedback control method may not be used at least in a portion of the first preheating section.

In detail, during a period between a heating start point and a preset reference time point (i.e., the first preheating section in FIG. 11), the controller 1080 may set the upper limit of the current applied to the coil 15.

The reference time point may be set based on a time taken by the susceptor 16 to reach the reference temperature. The reference temperature may be set differently based on whether the coil 15 performs the overshoot control. The reference temperature may be lower than the first target temperature. For example, the reference temperature may be lower than the first target temperature by about 30° C. to about 200° C.

In operation S1220, in the second preheating section, the controller 1080 may control the power supplied to the heating unit 1052 based on the second target temperature.

In the second preheating section, the controller 1080 may control the power converter 1051 to make the temperature of the susceptor 16 reach the second target temperature. In the second preheating section, the temperature of the susceptor 16 may increase to or above the second target temperature. The second target temperature may be higher than the first target temperature. Setting the first target temperature to be lower than the second target temperature is to prevent the carbonization of the aerosol-generating substrate which may be caused by the dramatic temperature increase of the susceptor 16 and to prevent the overload of the battery 1060 which may be caused by the abrupt supply of power at the heating start point.

As the aerosol-generating device 1 performs the two-step temperature control in the preheating section, the susceptor 16 may be stably preheated to the target temperature without the carbonization of the aerosol-generating substrate. Accordingly, the aerosol-generating device 1 may provide the sufficient amount of vapor with a good flavor to the user in the smoking section.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol-generating device comprising:

a battery;

a heating unit configured to heat an aerosol-generating substrate based on power supplied to the battery; and a controller configured to control power supplied to the heating unit, based on a temperature profile comprising a preheating section and a smoking section, wherein, in the preheating section, the controller is configured to control the power supplied to the heating unit, based on a first target temperature and a second target temperature, the first target temperature being reached prior to the second target temperature and the second target temperature being higher than the first target temperature.

2. The aerosol-generating device of claim 1, wherein the preheating section comprises a first preheating section and a second preheating section following the first preheating section, and the controller is configured to:

control the power supplied to the heating unit to make a temperature of the heating unit reach the first target temperature in the first preheating section; and control the power supplied to the heating unit to make the temperature of the heating unit reach the second target temperature in the second preheating section.

3. The aerosol-generating device of claim 2, wherein the first target temperature is set between about 250° C. and about 335° C., and the second target temperature is set between about 340° C. and about 360° C.

4. The aerosol-generating device of claim 2, wherein the controller is further configured to control the power supplied to the heating unit for a longer period of time in the first preheating section than the second preheating section.

5. The aerosol-generating device of claim 1, wherein the controller is configured to set an upper limit of a current applied to the heating unit in a portion of the heating section.

6. The aerosol-generating device of claim 1, wherein the controller is configured to control a current applied to the heating unit such that the temperature of the heating unit is maintained at a third target temperature in the smoking section.

7. The aerosol-generating device of claim 6, wherein the third target temperature is set to be lower than the second target temperature.

8. The aerosol-generating device of claim 6, wherein the third target temperature is set to be equal to the first target temperature.

9. The aerosol-generating device of claim 1, further comprising a power converter configured to convert direct current power supplied from the battery into alternating current power, wherein the heating unit comprises a coil configured to generate an alternating magnetic field, based on the alternating current power.

10. The aerosol-generating device of claim 9, wherein the heating unit further comprises a susceptor configured to generate heat by the alternating magnetic field, and the controller is configured to heat the susceptor by controlling the alternating power applied to the coil.

* * * * *